US006383025B1

(12) United States Patent
Shi et al.

(10) Patent No.: US 6,383,025 B1
(45) Date of Patent: May 7, 2002

(54) CABLE CONNECTOR ASSEMBLY

(75) Inventors: Guang Xing Shi; Sui Ya Wang, both of Kunsan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/975,034

(22) Filed: Oct. 10, 2001

(30) Foreign Application Priority Data

Apr. 24, 2001 (TW) ..... 090206478

(51) Int. Cl.[7] ..... H01R 13/648

(52) U.S. Cl. ..... 439/607; 439/497; 439/95; 439/108

(58) Field of Search ..... 439/607, 497, 439/95, 108

(56) References Cited

U.S. PATENT DOCUMENTS 6,183,281 B1 * 2/2001 Wu et al. ..... 439/607
6,273,753 B1 * 8/2001 Ko ..... 439/607
6,319,070 B1 * 11/2001 Tan ..... 439/607

* cited by examiner

*Primary Examiner*—Tho D. Ta
(74) *Attorney, Agent, or Firm*—Wei Te Chung

(57) ABSTRACT

A cable connector assembly includes an electrical connector (1), a wire-securing element (20) and a cable (30). The connector has an insulative housing (11), a plurality of electrical contacts (130) secured therein, and a metallic shield (12). The housing has a securing portion (1192) in each of opposite side walls (119) thereof. Each securing portion includes an upper horizontal slot (1193) and a vertical slot (1194) forming a t-shaped cross. The cable includes a plurality of signal wires (31) and a pair of ground wires (33). The shield has a pair of inwardly extending fastening projections (121). A signal conductor (32) of each signal wire electrically connects with a corresponding electrical contact. A ground conductor (34) of each ground wire is located into the corresponding vertical slot. Part of the ground conductor is pressed into the corresponding horizontal slot by the corresponding fastening projection of the shield.

6 Claims, 5 Drawing Sheets

CABLE CONNECTOR ASSEMBLY

BACKGROUND OF THE INVENTION

1. Field of the Invention

The present invention relates to cable connector assemblies, and more particularly to grounding structures of cable connector assemblies.

2. Description of the Related Art

A cable is commonly used between different electrical devices for connecting the devices and transmitting electrical signals therebetween. Typically, an electrical connector must secure an end portion of a cable such that a multiplicity of wires of the cable electrically connects with corresponding terminals of the connector. A conventional cable connector assembly is thereby made, for mating with electrical devices and providing electrical signal transmission.

To eliminate electromagnetic interference (EMI) and ensure stable signal transmission between a cable and an electrical connector, a shield of the electrical connector is commonly grounded. Grounding of a shield can be attained by a variety of means. One means is to solder the shield directly to electrical paths on a printed circuit board (PCB). An example of this means is disclosed in U.S. Pat. No. 5,772,466. However, solder used in this process is an alloy typically comprising tin and lead. When the alloy is heated and melted, it can be detrimental to an operator's health and can pollute the surrounding environment. Furthermore, it is difficult to unsolder the shield from the PCB should that be required later on.

Another means of grounding a shield is to settle grounding terminals in the connector housing, and connect the grounding terminals with the shield. An example of this means is disclosed in U.S. Pat. No. 5,228,872. However, this means also requires soldering of the grounding terminals to electrical paths on a PCB. This can be detrimental to an operator's health, and can pollute the surrounding environment. Furthermore, it is difficult to unsolder the shield from PCB should that be required later on.

In view of the above, a new cable connector assembly having an improved grounding structure is desired.

SUMMARY OF THE INVENTION

An object of the present invention is to provide a cable connector assembly wherein stable grounding of an electrical connector of the assembly is achieved without soldering.

Another object of the present invention is to provide a cable connector assembly having a grounding structure which connects between a cable of the assembly and an electrical connector of the assembly.

To fulfill the above objects, a cable connector assembly in accordance with the present invention comprises an electrical connector, a wire-securing element and a cable. The connector comprises an insulative housing, a plurality of electrical contacts secured therein, and a metallic shield. The housing has a receiving space for receiving a corresponding plug connector, and two securing portions for engaging with the shield. Each contact has a contact portion at a front end, an elastic engaging portion at a rear end, and a connecting portion between the contact portion and the engaging portion. The cable includes a plurality of signal wires and a pair of ground wires. Each signal wire and each ground wire respectively have an internal signal conductor and an internal ground conductor. Each signal conductor electrically connects with the engaging portion of a corresponding electrical contact. A pair of fastening projections extends inwardly from opposite side panels of the shield.

The securing portions are formed on opposite external side walls of the housing. Each securing portion comprises an upper horizontal slot and a vertical slot forming a t-shaped cross. The ground conductor of each ground wire is located in the corresponding vertical slot. Part of the ground conductor is pressed and secured into the corresponding horizontal slot by a corresponding fastening projection of the shield. Accordingly, the shield is connected with the ground wires, and any electrical charge that develops on the shield is dissipated out through the ground wires. Thus components enclosed within the shield are protected from EMI.

DESCRIPTION OF THE PREFERRED EMBODIMENT

Figures 1, 3:
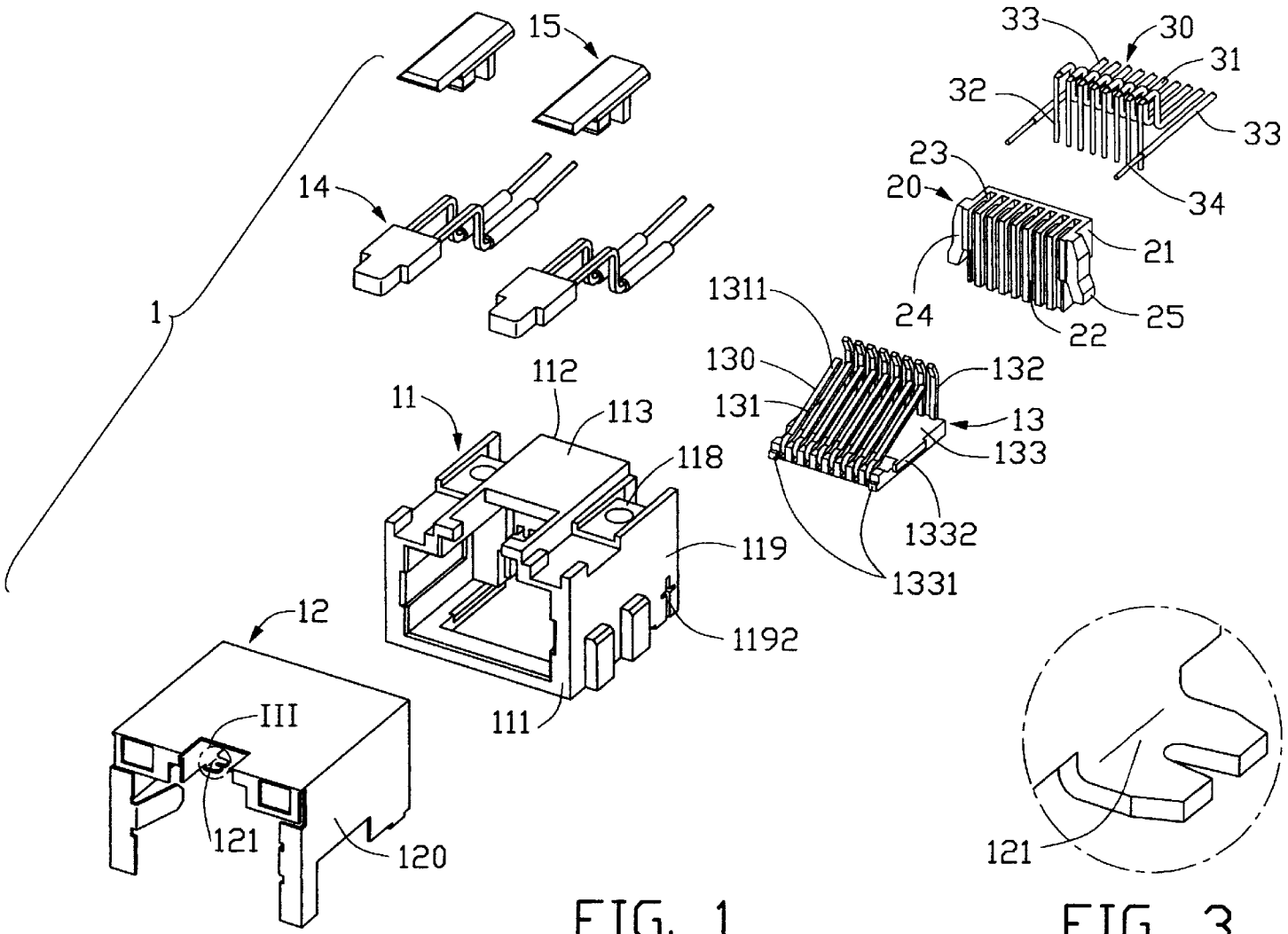
FIG. 1 is an exploded view of a cable connector assembly in accordance with a preferred embodiment of the present invention.
FIG. 3 is a enlarged view of the encircled portion III of FIG. 1.

Referring to FIG. 1, a cable connector assembly in accordance with a preferred embodiment of the present invention includes an electrical connector 1, a wire-securing element 20 and a cable 30. In the preferred embodiment, the electrical connector comprises an insulative housing 11, a metallic shield 12, a terminal module 13, two LED devices 14 and two locating slabs 15.

Figure 2:
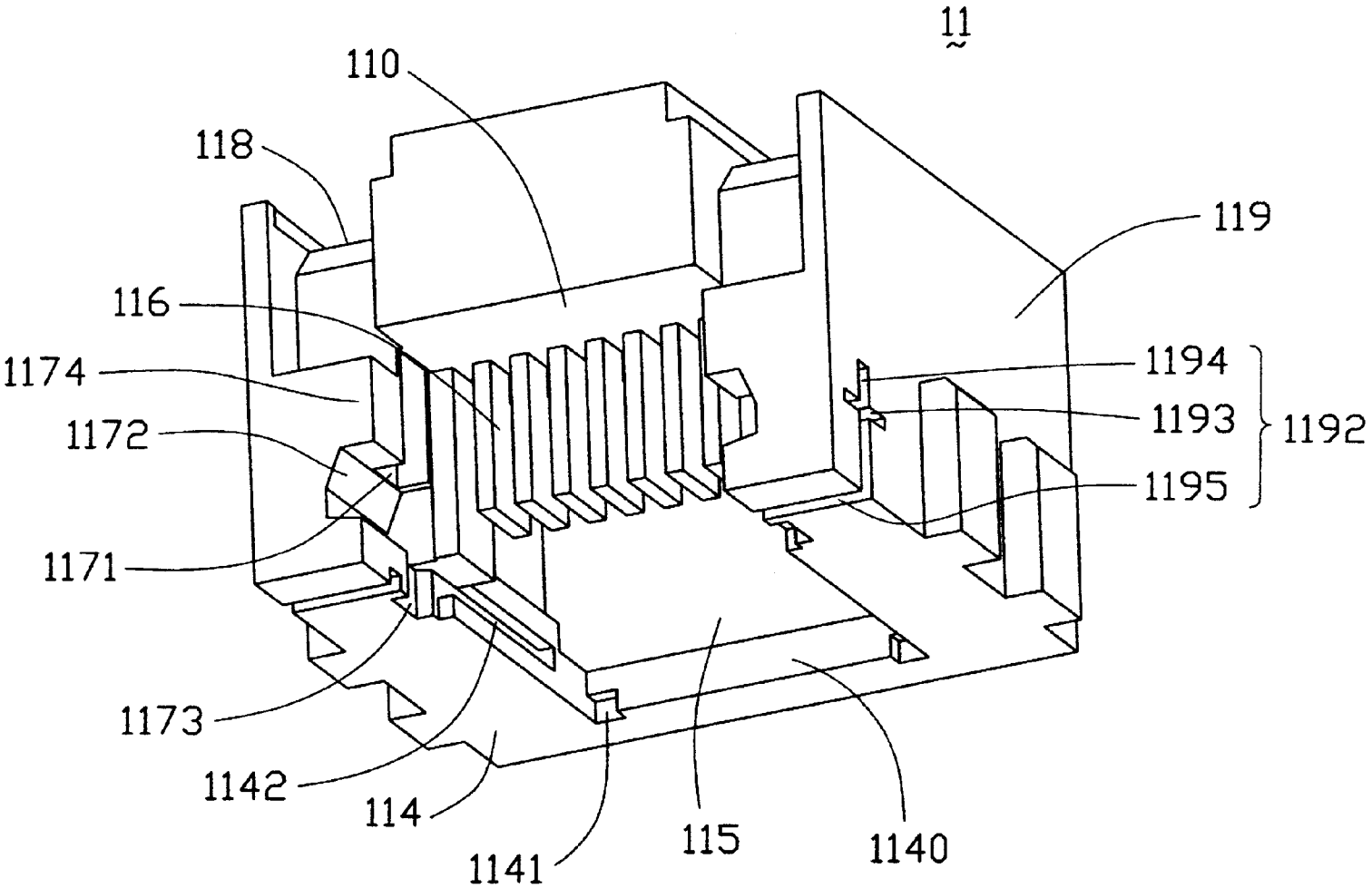
FIG. 2 is a perspective view of an insulative housing of an electrical connector of the cable connector assembly of FIG. 1.
Figure 4:
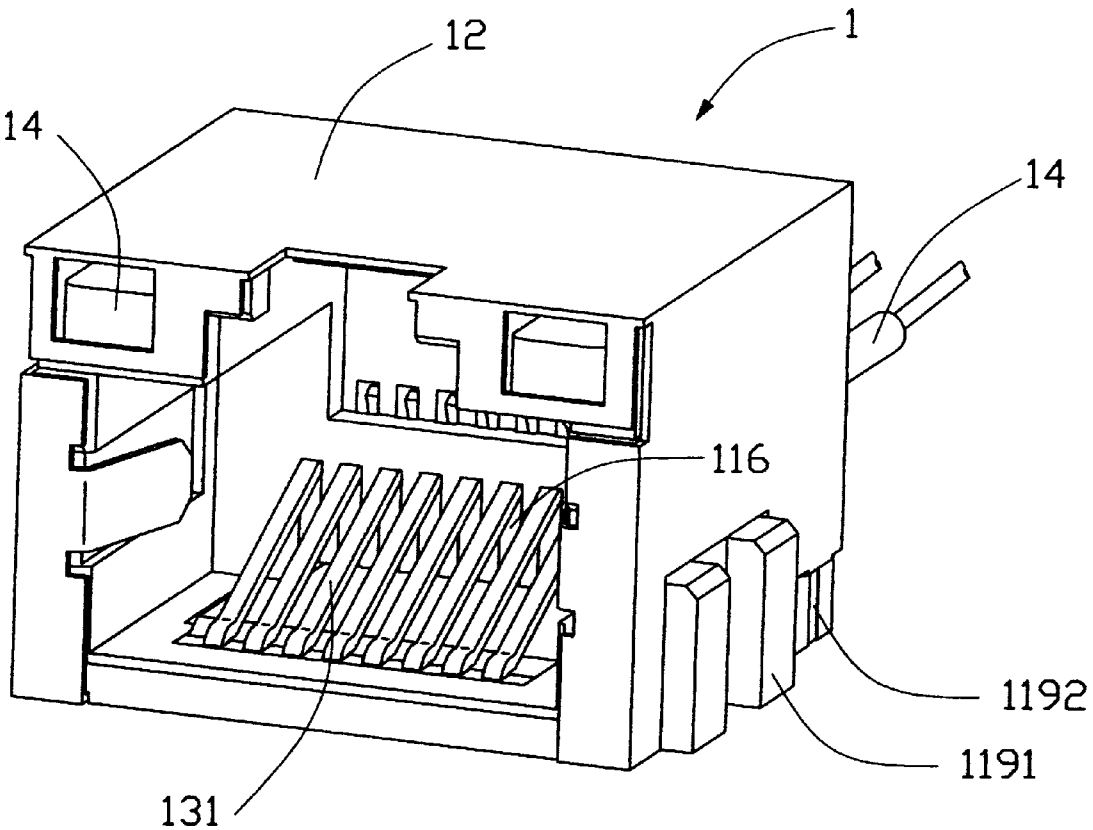
FIG. 4 is an assembled view of FIG. 1.

Referring particularly to FIGS. 1 and 2, the housing 11 of the connector 1 has a front wall 111, a back wall 112, a top wall 113, a bottom wall 114, two external side walls 119, and a receiving space 115. The receiving space 115 extends through the front wall 111 and the back wall 112, for receiving a corresponding RJ-45 modular plug.

A plurality of slots 116 is defined in the housing 11 in communication with a rear of the receiving space 115, for accommodating part of the terminal module 13. A receiving opening 110 is defined at a rear of and in communication with the slots 116, for accommodating the wire-securing element 20. A rectangular stop bar 1140 is formed at a front, lower end of the housing 11 and below the receiving space 115. A pair of notches 1141 is defined in lower portions of opposite ends of the stop bar 1140 respectively. A pair of grooves 1142 is defined in the housing 11 generally at opposite sides of a lower extremity of the first receiving space 115. Each groove 1142 extends from the back wall 112 to a point near to but rearward of the stop bar 1140. A pair of vertical rectangular recesses 1171 is respectively defined in the side walls 112. Each recess 1171 is in communication with the receiving opening 110, and the recesses 1171 oppose each other across the receiving opening 110. Two locking tabs 1174 are thereby formed in the back wall 112, adjacent rear extremities of the vertical recesses 1171 respectively. A polygonal cutout 1172 is defined below and in communication with each vertical recess 1171. A depression 1173 is defined through the bottom wall 114 at a rear of and in communication with each groove 1142, and below the corresponding cutout 1172. Two channels 118 are defined in the top wall 113 from the front wall 111 to the back wall 112, for accommodating the LED devices 14 therein. A pair of vertical ribs 1191 is formed on each external side wall 119 (see FIG. 3), for securing the cable connector assembly to other electrical devices. A pair of securing portions 1192 is respectively formed at junctions of the side walls 119 and the bottom wall 114, rearwardly of the vertical ribs 1191. In the preferred embodiment, each securing portion 1192 comprises an upper horizontal slot 1193 and a vertical slot 1194 both defined in an outside of the side wall 119, and a horizontal slot 1195 defined in an outside of the bottom wall 114. The upper horizontal slot 1193 and vertical slot 1194 form a t-shaped cross. The lower horizontal slot 1195 extends perpendicularly inwardly from the outside of the side wall 119, in communication with a bottommost portion of the vertical slot 1194.

Figure 5:
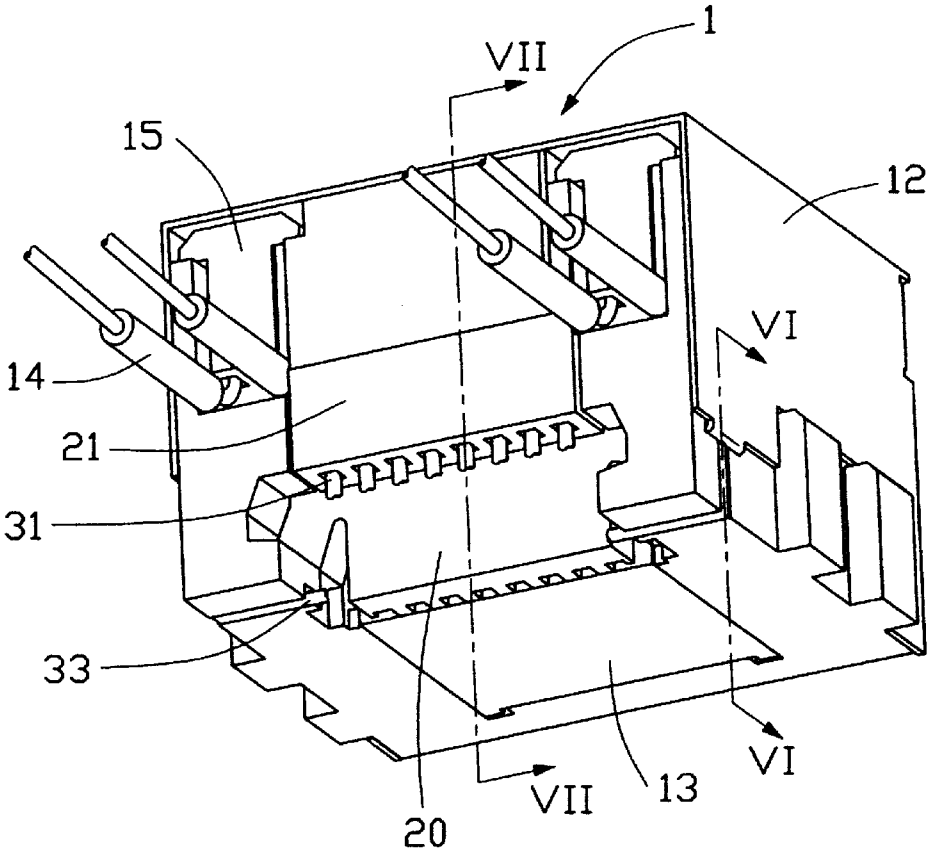
FIG. 5 is similar to FIG. 4, but viewed from a rear aspect.

Referring to FIGS. 1, 3 and 5, the shield 12 is formed from a metal sheet. A pair of fastening projections 121 extends inwardly from opposite side panels 120 of the shield 12 respectively, for engaging in the securing portions 1192 of the housing 11.

The terminal module 13 comprises an insulative base board 133, and a plurality of contacts 130 insert molded therein. The base board 133 is made of suitable insulative material such as plastic. Each contact 130 includes a contact portion 131, a connecting portion (see FIG. 7) secured into the base board 133, and an elastic engaging portion 132. The contact portion 131 extends rearwardly and upwardly from a front end of the connecting portion 134, at an acute angle therefrom. The elastic engaging portion 132 extends substantially vertically upwardly from a rear end of the connecting portion 134. Each contact portion 131 has a terminal 1311 at a distal end thereof. A pair of lugs 1331 extends forwardly from opposite sides of a front portion of the base board 133, for engaging in the notches 1141 of the housing 11. A pair of engaging bars 1332 is formed on opposite sides of the base board 133 respectively, for engaging in the grooves 1142 of the housing 11.

The wire-securing element 20 has a terraced base 21, a plurality of L-shaped receiving grooves 22, and a plurality of vertical through holes 23. The receiving grooves 22 are defined in a front portion and a top portion of the base 21, for receiving the engaging portions 132 of the terminal module 13. The through holes 23 are defined in a rear portion of the base 21, and are respectively in communication with rear extremities of the receiving grooves 22. A pair of arms 24 extends from opposite sides of the base 21 respectively, for engaging in the vertical recesses 1171 of the housing 11. A latching end 25 is outwardly and downwardly formed at a bottom portion of each arm 24, for engaging in the corresponding cutout 1172 of the housing 11.

The cable 30 comprises a plurality of signal wires 31, and a pair of ground wires 33. Each signal wire 31 has an internal signal conductor 32. Each ground wire 33 has an internal ground conductor 34. The signal wires 31 are located into the wire-securing element 20. The ground wires 33 are located into the securing portions 1192 of the housing 11.

In assembly, the terminal module 13 is inserted into the housing 11 from outside the back wall 112 of the housing 11. The contact portions 131 of the contacts 130 of the terminal module 13 are received in the receiving space 115 of the housing 11. The terminals 1311 of the contacts 13 are engaged in the slots 116, and the engaging portions 132 of the contacts 130 are exposed in the receiving opening 110 of the housing 11. At the same time, the base board 133 of the terminal module 13 abuts the stop bar 1140 of the housing 11. The lugs 1331 and the engaging bar 1332 of the terminal module 13 are respectively fittingly engaged in the notches 1141 and the grooves 1142 of the housing 11. The LED devices 14 are then inserted into the channels 118 of the housing 11. The locating slabs 15 are inserted into the channels 118, to locate the LED devices 14 therein.

Figure 6:
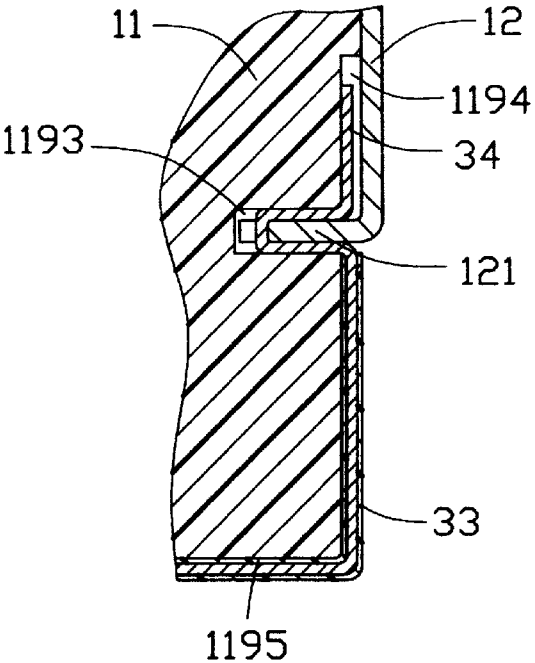
FIG. 6 is a cross-sectional view of the cable connector assembly FIG. 5, taken along line VI—VI of FIG. 5, and showing part of a shield of the electrical connector connecting with a grounding wire of the cable connector assembly.
Figure 7:
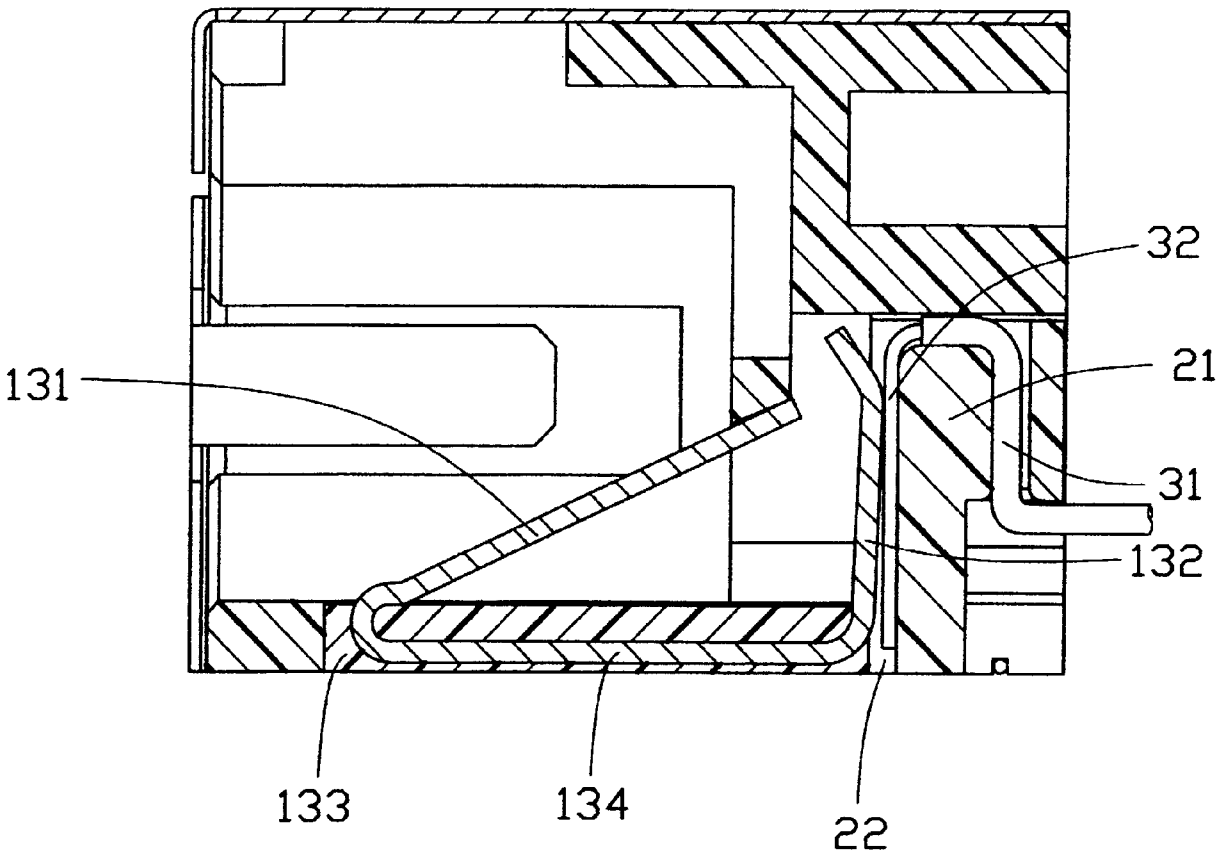
FIG. 7 is a cross-sectional view of the cable connector assembly of FIG. 5, taken along line VII—VII of FIG. 5, and showing an electrical terminal of the electrical connector connecting with a signal wire of the cable connector assembly.

Referring to FIGS. 5, 6 and 7, the cable 30 is then assembled into the electrical connector 1. Sheaths of the signal wires 31 and the ground wires 33 of the cable 30 are removed to expose the signal conductors 32 and the ground conductors 34 therein. The signal wires 31 are inserted into the through holes 23 of the wire-securing element 20 from a lower end thereof, such that end portions of the signal wires 31 and the exposed signal conductors 32 protrude out beyond upper ends of the through holes 23. The exposed signal conductors 32 are then accommodated in the receiving grooves 22 of the wire-securing element 20.

The pre-assembled wire-securing element 20 is then pressed upwardly into the housing 11 from outside the bottom wall 114 of the housing 11. The arms 24 of the wire-securing element 20 are initially received in and guided along the depressions 1173 of the housing 11. The arms 24 engage in the vertical recesses 1171 of the housing 11, and are locked therein by the locking tabs 1174 of the housing 11. The latching ends 25 of the wire-securing element 20 engage in the polygonal cutouts 1172 of the housing 11. When the wire-securing element 20 together with the signal wires 31 is secured to the housing 11, the engaging portions 132 of the contacts 130 extend into the receiving grooves 22 to electrically engage with the exposed signal conductors 32 of the signal wires 31. The contacts 130 and the signal wires 31 are thereby electrically connected together. Referring to FIG. 5, the ground wires 33 of the cable 30 are located into the lower horizontal slots 1195 and into portions of the vertical slots 1194 that are below the upper horizontal slots 1193. The exposed ground conductors 34 are located into the upper horizontal slots 1193 and portions of the vertical slots 1194 that are above the upper horizontal slots 1193. The fastening projections 121 of shield 12 are inserted into the upper horizontal slots 1193, such that portions of the exposed ground conductors 34 are pressed and secured into the upper horizontal slots 1193 by the fastening projections 121. Accordingly, the shield 12 is connected with the ground wires 33, and any electrical charge that develops on the shield 12 can be dissipated out through the ground wires 33. Thus components enclosed within the shield 12 are protected from EMI.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cable connector assembly, comprising:

an insulative housing having at least one securing portion, a receiving space being defined in the housing, and a receiving opening being defined in a rear of the housing;

a plurality of electrical contacts fixed in the housing, each of the contacts comprising a connecting portion, a contact portion extending rearwardly and upwardly from a front end of the connecting portion at an acute angle therefrom, and an engaging portion extending from a rear end of the connecting portion;

a cable including a plurality of signal wires and at least one ground wire, each of the signal wires having a signal conductor therein, each of the signal conductors electrically connecting with the engaging portion of a corresponding electrical contact, each of the at least one ground wire having a ground conductor therein; and a conductive shield, covering the housing and connecting with the ground conductor of the at least one ground wire, the ground conductor being located in the at least one securing portion of the housing; wherein the at least one securing portion of the housing is located in at least one of opposite sides of the housing, and each of the at least one securing portion includes a horizontal slot and a vertical slot forming a t-shaped cross.

2. The cable connector assembly as claimed in claim 1, wherein each of the at least one securing portion of the housing further includes another horizontal slot defined in a bottom wall of the housing and being in communication with the vertical slot.

3. The cable connector assembly as claimed in claim 1, wherein at least one fastening projection is formed on at least one of opposite side panels of the shield, and the at least one fastening projection extends into the horizontal slot of the at least one securing portion and presses the ground conductor into the said horizontal slot, such that the at least one fastening projection and the ground conductor are secured in the at least one securing portion.

4. The cable connector assembly as claimed in claim 1, further comprising a wire-securing element inserted into the receiving opening of the housing, the wire-securing element including a base and a plurality of receiving grooves defined in a front portion of the base, the receiving grooves receiving at least parts of the engaging portions of the contacts.

5. The cable connector assembly as claimed in claim 4, wherein the signal wires are secured between the wire-securing element and the housing, and the signal conductors are located in the receiving grooves of the wire-securing element.

6. An electrical cable connector assembly, comprising:

an insulative housing defining a receiving space therein;

a contact module fixed in the housing, the contact module having a plurality of contacts, each of the contacts having a contact portion upwardly and rearwardly extending in the receiving space for electrically engaging with a mating connector, each of the contacts further having an engaging portion;

a cable including a plurality of signal wires, each of the signal wires electrically connecting with the engaging portion of each of the contacts, the cable further including at least one ground wire having a ground conductor extending in a slot defined in a side wall of the housing; and a shield enclosing the housing for providing electromagnetic interference protection to the connector, the shield having a projection extending into the slot in the side wall to provide secure engagement with the ground conductor whereby the ground conductor is fixed in the slot and electrically connects with the shield.

* * * * *